US008238572B2

(12) United States Patent
Park et al.

(10) Patent No.: US 8,238,572 B2
(45) Date of Patent: Aug. 7, 2012

(54) SPEAKER DEVICE OF MOBILE COMMUNICATION TERMINAL FOR OUTPUTTING HIGH QUALITY SOUND

(75) Inventors: Dong-Ik Park, Seoul (KR); Soon-Youl Kwon, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 747 days.

(21) Appl. No.: 12/210,676

(22) Filed: Sep. 15, 2008

(65) Prior Publication Data

US 2009/0080678 A1 Mar. 26, 2009

(30) Foreign Application Priority Data

Sep. 21, 2007 (KR) ..... 10-2007-0096808

(51) Int. Cl.
*H04R 1/02* (2006.01)

(52) U.S. Cl. ..... 381/89; 381/182; 381/335

(58) Field of Classification Search ..... 381/89, 381/332, 335, 120, 186, 386, 345, 300, 308, 381/87, 333, 334, 182, 337; 379/430; 181/198, 181/199

See application file for complete search history.

(56) References Cited

U.S. PATENT DOCUMENTS

| | | | | |
|---|---|---|---|---|
| 4,182,931 | A * | 1/1980 | Kenner | 381/89 |
| 5,177,329 | A * | 1/1993 | Klayman | 181/156 |
| 5,187,333 | A | 2/1993 | Adair | |
| 5,361,380 | A * | 11/1994 | You et al. | 381/349 |
| 6,075,868 | A * | 6/2000 | Goldfarb et al. | 381/301 |
| 7,876,922 | B2 * | 1/2011 | Park et al. | 381/388 |
| 2004/0246607 | A1 * | 12/2004 | Watson et al. | 359/872 |
| 2006/0129258 | A1 | 6/2006 | Ninomiya | |
| 2007/0081691 | A1 * | 4/2007 | Park et al. | 381/386 |
| 2008/0000715 | A1 * | 1/2008 | Bouvier | 181/156 |
| 2008/0031474 | A1 * | 2/2008 | Berardi et al. | 381/99 |
| 2010/0210310 | A1 | 8/2010 | Inoue | |

FOREIGN PATENT DOCUMENTS

| | | |
|---|---|---|
| CN | 1946245 | 4/2007 |
| EP | 1 221 823 | 7/2002 |
| EP | 1 773 094 | 4/2007 |
| KR | 1020070038750 | 4/2007 |
| WO | WO 2007/060730 | 5/2007 |

* cited by examiner

*Primary Examiner* — Vivian Chin
*Assistant Examiner* — Friedrich W Fahnert
(74) *Attorney, Agent, or Firm* — The Farrell Law Firm, P.C.

(57) ABSTRACT

A speaker device employing a diaphragm structure for providing high quality sound characteristics. In particular, a separate speaker unit is additionally provided so as to improve a resonator characteristic produced at the rear side of an existing speaker. As such, the rear sound arriving at an end of the resonator is dampened by the sound outputted from the additional speaker unit, thereby improving characteristics, such as clearness, total harmonic distortion, etc.

9 Claims, 4 Drawing Sheets

SPEAKER DEVICE OF MOBILE COMMUNICATION TERMINAL FOR OUTPUTTING HIGH QUALITY SOUND

This application claims priority under 35 U.S.C. §119(a) to an application filed in the Korean Intellectual Property Office on Sep. 21, 2007 and assigned Serial No. 2007-96808, the contents of which are hereby incorporated by reference.

BACKGROUND OF THE INVENTION

1. Field of the Invention

The present invention relates to a mobile communication terminal, and in particular to a speaker device adapted to be capable of providing high quality sound.

2. Description of the Related Art

Typically, a mobile communication terminal is provided with a space for mounting a speaker device, which is limited in size due to the limitation of the size of such a mobile communication terminal. Therefore, the improvement of sound quality and clearness can be expected depending on how to use the space.

Nowadays, in order to provide a speaker device suitable for DMB (Digital Multimedia Broadcasting), a separate speaker unit is additionally provided, beyond a speaker unit for outputting a receiving sound and bell sound. In order to allow a user to enjoy the DMB, what is needed is high quality audio performance for outputting a sound resembling the original sound.

In the past, attempts had been made for improving sound volume and quality by fixing a speaker and securing a resonant space for sealing. With this measure, an increase in sound pressure and partially in bass can be expected. However, it is still required to further improve sound quality, clearness, and THD (Total Harmonic Distortion). In order to solve this problem, a method for improving a bass region by implementing a speaker device employing a diaphragm structure has been developed.

FIG. 1 illustrates an example of a speaker device 100 of a mobile communication device, which employs a conventional diaphragm structure, wherein the speaker device 100 includes a speaker housing having a sub-housing 101*a* and a cover 101*b*. The speaker housing is provided with a mounting space 102*a* for mounting a speaker unit 109, and a resonant space 102*b* connected to the mounting space 102*a*.

One side of the sub-housing 101*a* is opened, and a plurality of diaphragms 113 of various shapes is formed inside the sub-housing 101*a*. The diaphragms 113 serve to divide lie internal space of the sub-housing 101*a*. Such a speaker device employing the above-mentioned diaphragm structure should be improved in terms of THD which is a principal cause deteriorating high quality audio performance.

Like this, with the existing constructions of speaker devices, there are limitations in providing a sound resembling an original sound when enjoying DMB or the like. In addition, because users typically enjoy DMB in a state in which the volume is increased, speaker devices should be improved in terms of sound characteristics, even in the state in which the volume is increased. Furthermore, it is required to develop a speaker device capable of improving clearness and THD while complementing areas vulnerable in bass reproducing characteristics.

SUMMARY OF THE INVENTION

Accordingly, the present invention has been made to solve the above-mentioned problems occurring in the prior art, and the present invention provides a speaker device adapted to be capable of providing high quality sound performance, even though it is installed within a mobile communication terminal.

In addition, the present invention is intended to provide a speaker device of a mobile communication device adapted capable of improving THD (Total Harmonic Distortion) so that a sound resembling an original sound can be provided while a user is enjoying DMB (Digital Multimedia Broadcasting).

According to an aspect of the present invention, there is provided a speaker device of a mobile communication terminal for outputting a high quality sound, including a sub-housing having an internal space divided into a mounting space for mounting a first speaker unit and a resonant space by diaphragms formed inside the internal space, wherein the sub-housing further includes a sound passage formed by the diaphragms, and a second speaker unit is mounted at a distal end portion of the sound passage with reference to the mounting space so as to dampen a rear side sound of the first speaker unit; and a cover coupled to the sub-housing.

According to a second aspect of the present invention, there is provided a speaker device of a mobile communication terminal for outputting a high quality sound, including an amplifier for amplifying and outputting an audio signal; a first speaker unit connected to the output terminal of the amplifier, the first speaker unit outputting the audio signal inputted from the amplifier to the outside; and a second speaker unit connected to the input terminal of the amplifier, wherein, if an audio signal identical to the audio signal inputted to the amplifier is inputted to the second speaker unit, the second speaker unit outputs the inputted audio signal toward a first speaker unit mounting space so as to dampen an audio signal from the rear side of the first speaker unit, wherein the speaker device has an internal space divided into a plurality of spaces by diaphragms formed inside the speaker device, and a sound passage is also formed by the diaphragms, the second speaker unit being placed at a distal end portion of the sound passage with reference to the first speaker unit mounting space, among the spaces formed by the diaphragms, so as to dampen a rear side sound of the first speaker unit.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, exemplary embodiments of the present invention will be described with reference to the accompanying drawings. In the following description of the present invention, a detailed description of known functions and configurations incorporated herein will be omitted for clarity and conciseness.

The present invention provides a speaker device employing a diaphragm structure for providing a high quality sound characteristic. Especially, the present invention additionally mounts a separate speaker unit in such a speaker device employing a diaphragm structure, so as to improve a resonator characteristic occurring on the rear side of an original speaker unit. As such, the sound produced from the rear side of the original speaker unit and arriving at a distal end portion of a resonator is dampened by the sound provided through the additional speaker unit, whereby the characteristics, such as clearness and THD (Total Harmonic Distortion), can be improved.

Now, a speaker device of a mobile communication device, which is provided with an additional speaker unit according to an embodiment of the present invention will be described with reference to FIG. 2.

Figure 1:
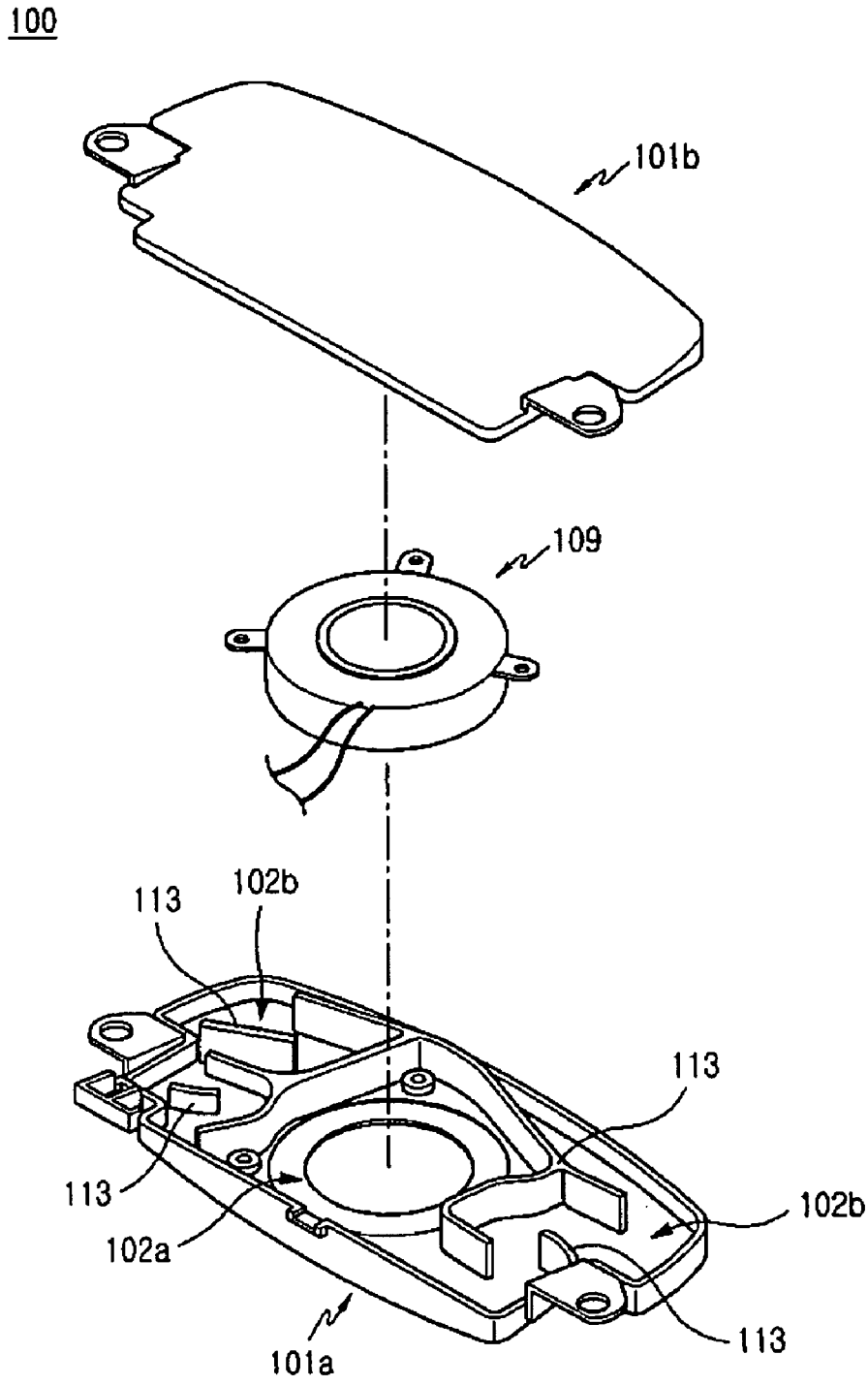
FIG.1 (PRIOR ART)
FIG. 1 is an exploded perspective view showing a speaker device for a mobile communication terminal, which employs a conventional diaphragm structure.
Figure 2:
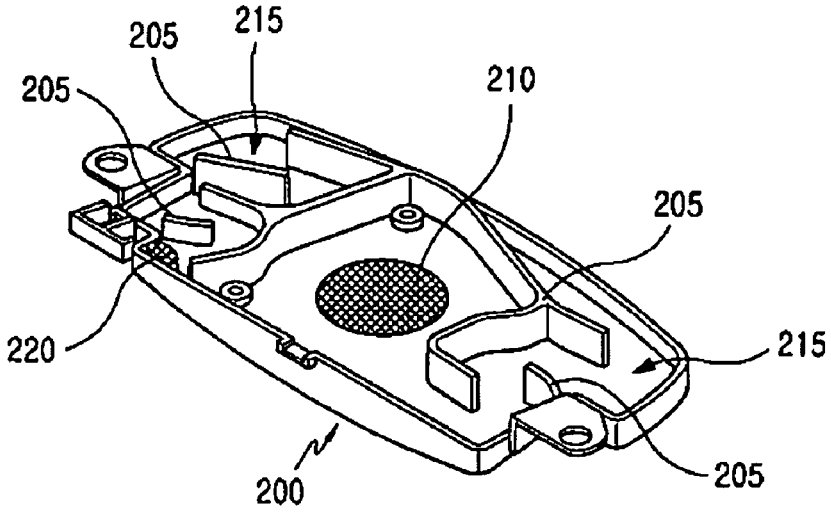
FIG. 2 is an exploded perspective view showing a speaker device for a mobile communication terminal, which is provided with an additional speaker unit according to an embodiment of the present invention.

FIG. 2 illustrates an example of a sub-housing 200 when a speaker device is disassembled, wherein the sub-housing 200 has an internal space divided by diaphragms 205. A resonant space 215 is formed by the diaphragms 205, wherein the resonant space 215 is defined as a space exclusive of the spaces for mounting the speaker units. In other words, the internal space, which is divided by the diaphragms formed inside the speaker device, is provided with a resonant space outside the first speaker unit mounting space. The sub-housing 200 with the resonant space 215 is coupled with a cover (not shown), thereby being closed.

According to the present invention, a second speaker unit is additionally provided so as to improve characteristics, such as THD or the like due to the rear side sound of the first speaker unit. Referring to the positions for mounting the first and second speaker units, the first speaker unit is mounted in the space designated by reference numeral 210, and the second speaker unit is mounted in the space designated by reference numeral 220. At this time, the second speaker unit is preferably mounted at a distal end portion of a sound passage between the diaphragms 205 so as to dampen the rear side sound of the first speaker unit arriving at the distal end portion of the sound passage.

Meanwhile, when configuring a resonant space in a speaker device of a mobile communication terminal, resonant frequency is determined by the volume of the speaker device and the length of a sound passage. That is, the resonant frequency of a speaker device is inversely proportional to the volume of the internal space of the speaker device and the length of the sound passage, and proportional to the cross-sectional area of the sound passage. However, because the speaker device is limited in size and the internal space of the speaker housing is also limited, it is required to design the sound passage so as to improve the sound characteristics in the fixed resonant space. The design is made in such a manner that the cross-sectional area of the sound passage in the resonant space in the speaker housing is reduced while increasing the length of the sound passage. By designing the sound passage in this manner, it is possible to secure a resonant space with resonant diaphragms without using a separate resonance box, and by using such a diaphragm structure, it is advantageous in stressing the bass region of a sound outputted from the speaker device.

In general, if a speaker device for a specific frequency band is mounted in the sub-housing 200 without a diaphragm, it is difficult for the speaker device to properly implement a sound beyond the specific frequency band. For example, if the first speaker unit is for the 1 kHz band, its resonant frequency is increased more than 1 to 1.2 kHz. If so, the speaker device cannot properly implement the sound of bass region. In such a case, in order to complement bass below 1 kHz for the first speaker unit, the length of the sound passage is set to the length corresponding to $\lambda/2$ at 34 cm which is the 1 kHz frequency wavelength, i.e. to the length corresponding to 17 cm. Like this, in the inventive speaker device, it is preferable to set the length of the sound passage to correspond to a half of the resonant frequency wavelength of the speaker unit. By forming the resonant space 215 with such a sound passage length, the influence transmitted to the rear side of the first speaker unit will be reduced.

Figure 3:
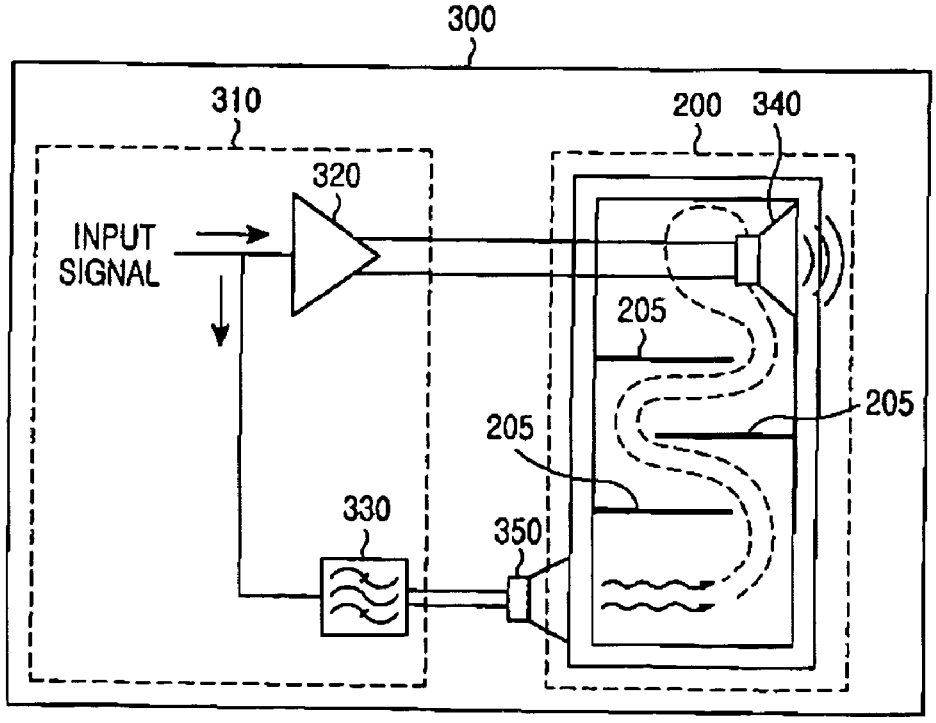
FIG. 3 is a schematic diagram showing the construction of a mobile communication terminal provided with the speaker device of FIG. 2.

Now, the present invention will be described with reference to FIG. 3 showing the construction of a mobile communication terminal with the speaker device shown in FIG. 2.

FIG. 3 illustrates the schematic construction of a mobile communication terminal 300, in particular constituents, such as a voice processing unit 310, a sub-housing 200, etc.

The voice processing unit 3 10 includes an amplifier 320 and a filter 330, wherein the amplifier 320 amplifies and transmits an audio signal inputted thereto to a first speaker unit 340. The first speaker unit 340 is connected with the output terminal of the amplifier 320, and serves to output an audio signal inputted from the amplifier 320 to the outside.

An audio signal identical to die audio signal inputted to the amplifier 320 is transmitted to a second speaker unit 350. A filter 330 may be additionally provided between the input terminal of the amplifier 320 and the input terminal of the filter 330 so that a user uses a desired frequency band. As a result, the signal identical to the audio signal inputted to the amplifier 320 is filtered through the filter 330 and transmitted to the second speaker unit 350. Here, if the second speaker unit 350 is a full range speaker unit, the filter 330 passes only a signal waveform corresponding to a frequency band desired by the user, and transmits the signal waveform to the second unit 350. For the filter 330 executing such a function, a low pass filter (LPF), a high pass filter (HPF), and a band pass filter (BPF) may be employed.

Similarly, the second speaker unit 350 may be connected with the input terminal of the amplifier 320 either directly or through the filter 330. If the audio signal identical to the audio signal inputted to the amplifier 320 is inputted to the second speaker unit 350, the second speaker unit 350 outputs the audio signal inputted thereto toward a space where the first speaker unit 340 is mounted so as to dampen an audio signal produced at the rear side of the first speaker unit to with the audio signal outputted from the second speaker unit 350. The second speaker unit 350 is positioned at a distal end portion of a sound passage formed by diaphragms 205 with reference to the first speaker unit mounting space among the internal spaces divided by the diaphragms 205 formed inside the speaker device 200.

Meanwhile, the first speaker unit 340 is used for outputting a sound produced due to DMB (Digital Multimedia Broadcasting), and the second speaker unit 350 is used for improving the outputting characteristics of the first speaker unit 340 rather than for outputting a sound. Especially, the magnitude of a signal outputted through the second speaker unit 350 should be substantially equal to that of a signal of the rear side sound of the first speaker unit 340 so as to dampen the rear side sound with the signal outputted through the second speaker unit 350. Like this, a sound is also outputted from the rear side of the first speaker unit beyond from the front side of the first speaker unit. Assuming that the front side sound and the rear side sound are outputted in a ratio of 9:1, 8:1, or the like in magnitude, the magnitude of a signal outputted from the second speaker unit 350 becomes substantially equal to that of a signal from the rear side of the first speaker unit 340 because the signal outputted from the second speaker unit 350 does not pass through the amplifier 320.

Now, the operating process of the second speaker unit 350 will be described in detail.

If an input signal is simultaneously transmitted to both the amplifier 320 and the filter 330, each of the first speaker unit 340 and the second speaker unit 350 outputs a signal. At this time, the sound produced from the rear side of the first speaker unit 340 moves along the sound passage formed by the diaphragms 205 and arrives at the end portion of the sound passage, wherein the sound is dampened by the sound produced from the second speaker unit 350 mounted at the distal end portion of the sound passage. That is, the rear side sound of the first speaker unit 340 meets the front side sound of the second speaker unit 350, and is dampened by the front side sound of the second speaker unit 350. In his manner, the rear side sound of the first speaker unit 340 can be inaudible, and the front side sound of the first speaker unit 340 can be heard without being hindered by the rear side sound.

In addition, according to the present invention, if a separate speaker is additionally used as described above in all the cases where the diaphragms are used, it is possible to process sound existing around the speaker used for outputting sound.

Figure 4:
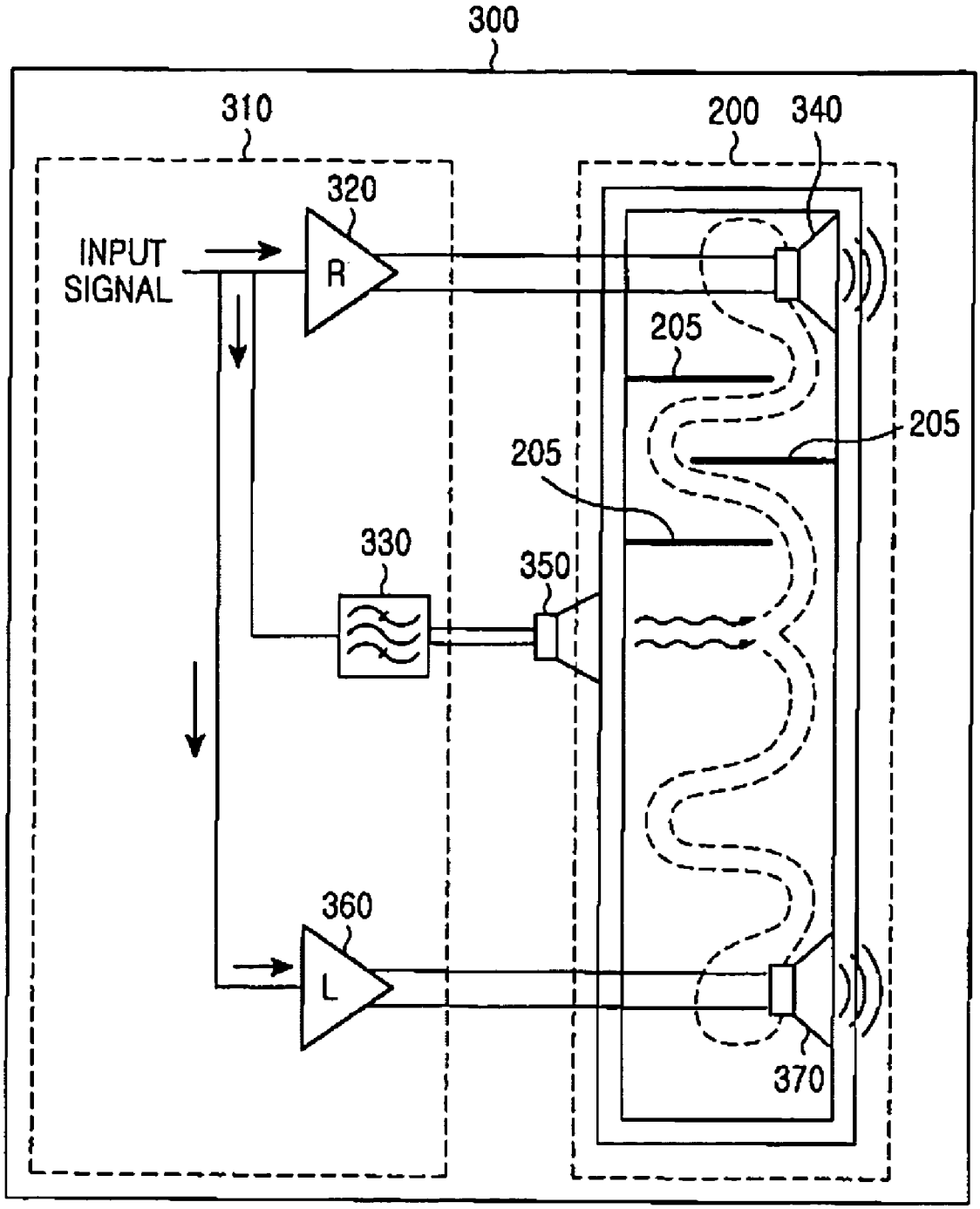
FIG. 4 is a schematic diagram showing tile construction of a speaker device for a stereo mobile communication terminal according to another embodiment of the present invention.
Figure 5:
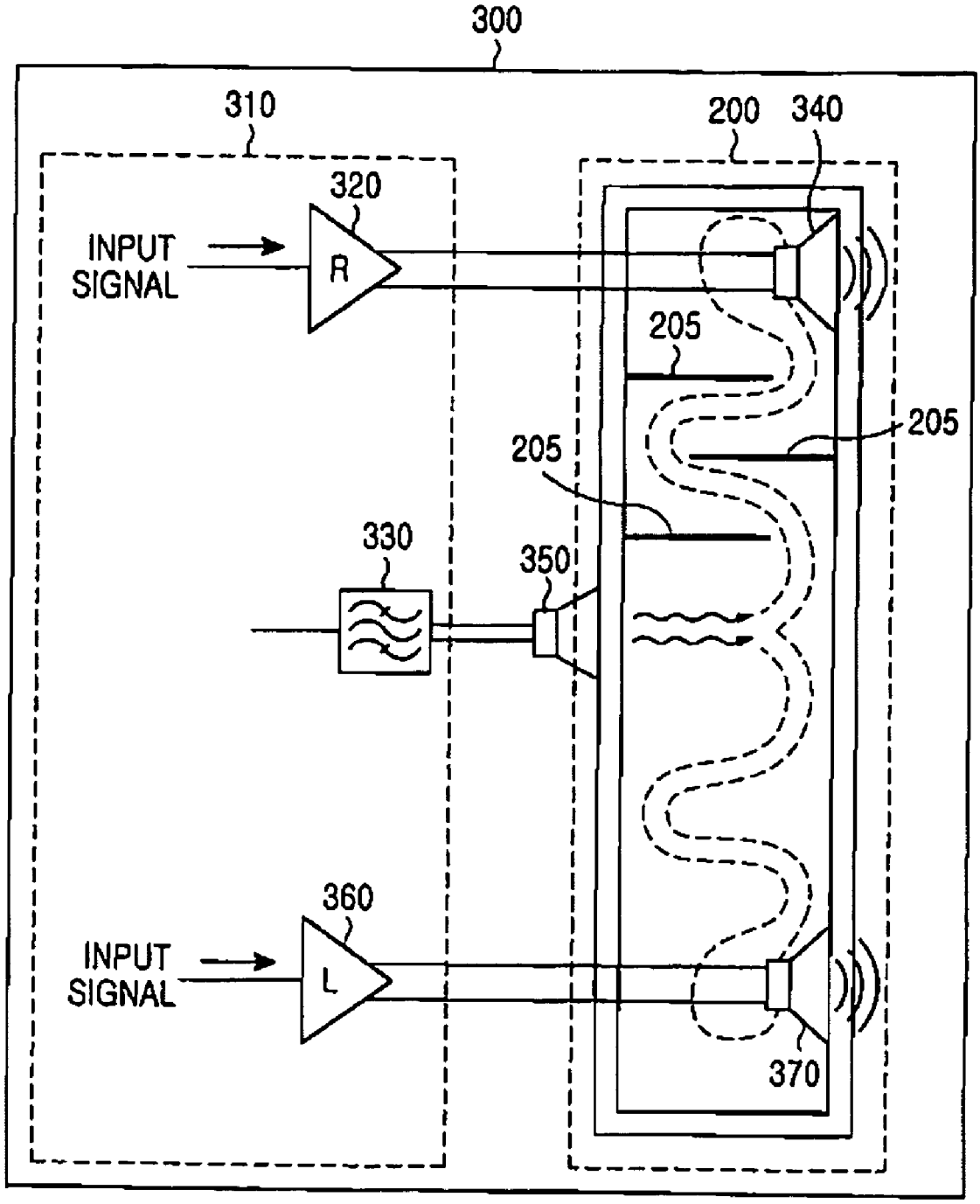
FIG. 5 is a schematic diagram showing the construction of a speaker device for a stereo mobile communication terminal according to another embodiment of the present invention.

Meanwhile, the measure of dampening noise by additionally mounting a separate speaker as described above can be applied to a stereophonic mobile communication terminal. FIG. 4 illustrates a stereophonic mobile communication terminal equipped with an additional speaker. A stereophonic mobile communication terminal is equipped with two speakers corresponding to left and right sides, respectively. In FIG. 4, if the speaker unit corresponding to the right side is a first speaker unit 340, and the speaker unit outputting a signal inputted through the amplifier 360 is a third speaker unit 370, it is possible to dampen the sounds produced from the first speaker unit 340 and the third speaker unit 370 by mounting a second speaker unit 350. Unlike that shown in FIG. 4, the speaker device can be implemented as shown in FIG. 5, so that input signals are transmitted to the amplifier 320, the filter 330, and the amplifier 360, respectively for the first, second and third speaker units 340, 350 and 370.

In order to observe how much THD (Total Harmonic Distortion) is improved when the inventive additional speaker unit is employed, reference is made to Table 1 and Table 2 below. Table 1 and Table 2 comparatively show the performance of a speaker device provided in a conventional communication terminal and the characteristic of the inventive speaker device.

TABLE 1

| THD | Conventional | Present invention | Improved rate |
|---|---|---|---|
| 800 Hz | 14.44% | 12.59% | 12.81% up |
| 1 kHz | 10.78% | 9.41% | 12.7% up |
| 5 kHz | 0.10% | 0.10% | — |

Table 1 shows the improved ratio in total harmonic distortion characteristic in the case of low gain. As comparatively shown in Table 1, it can be found that the sound from the inventive speaker device is improved 12% or more in total harmonic distortion characteristic as compared to the conventional speaker device.

TABLE 2

| THD | Conventional | Present invention | Improved rate |
|---|---|---|---|
| 800 Hz | 18.37% | 15.80% | 14% up |
| 1 kHz | 13.97% | 11.89% | 14.9% up |
| 5 kHz | 0.10% | 0.10% | — |

Table 2 shows the improved ratio in total harmonic distortion characteristic in the case of high gain.

From Table 1 and Table 2, it can be found that the improved rate in the high gain is higher than that in the low gain. This means that, with volume tuned higher, the user can hear more improved sound. Considering that users typically watch DMB (Digital Multimedia Broadcasting) with increased volume, it is concluded that this improves the sound quality more effectively.

According to the present invention, when enjoying a multimedia file, watching DMB, or the like, a sound resembling an original sound can be implemented through a speaker device by improving sound pressure output. In addition, according to the present invention, sound characteristics can be improved merely by adding one speaker unit so as to improve the resonant characteristic caused by a sound emanating from the rear side of a speaker. In particular, a high-quality plentiful sound can be provided.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A speaker device for outputting a sound, comprising:

a housing having an internal space divided by at least one diaphragm formed inside the internal space into a mounting space for mounting a first speaker unit and a resonant space exclusive of the mounting space, wherein the housing further includes a sound passage formed by the at least one diaphragm, and a second speaker unit is mounted at a distal end portion of the sound passage, and wherein the second speaker unit outputs a second sound to dampen a rear sound outputted from a rear side of the first speaker unit.

2. The speaker device as claimed in claim 1, wherein the length of the sound passage corresponds to a half of the resonant frequency wavelength of the first speaker unit.

3. A speaker device for outputting a sound, comprising:

an amplifier outputting a first audio signal;

a first speaker unit connected to an output terminal of the amplifier, the first speaker unit outputting a first sound from the first audio signal; and a second speaker unit connected to an input terminal of the amplifier, wherein, when a second input audio signal identical to a first input audio signal inputted to the amplifier is inputted to the second speaker unit, the second speaker unit outputs a second sound to dampen a rear sound outputted from a rear side of the first speaker unit, wherein the speaker device has an internal space divided by at least one diaphragm into a sound passage and a mounting space for mounting the first speaker unit, the second speaker unit being placed at a distal end portion of the sound passage with reference to the mounting space.

4. The speaker device as claimed in claim 3, further comprising a filter connected between the input terminal of the amplifier and an input terminal of the second speaker unit, wherein, when a third audio signal identical to the first audio signal is inputted to the filer, the filter filters the third audio signal and transmits the filtered third audio signal to the second speaker unit.

5. The speaker device as claimed in claim 4, wherein the filter is at least one of a low pass filter, a high pass filter, and a band pass filter.

6. The speaker device as claimed in claim 3, wherein the length of the sound passage corresponds to a half of the resonant frequency wavelength of the first speaker unit.

7. The speaker device as claimed in claim 3, wherein the internal space is provided with a resonant space being outside of and connected to the mounting space.

8. The speaker device as claimed in claim 1, wherein the second speaker unit is mounted at the distal end portion of the sound passage with reference to the mounting space so as to dampen a rear side sound of the first speaker unit.

9. The speaker device as claimed in claim 1, further comprising a cover coupled to the housing.

* * * * *